United States Patent [19]

Hudson

[11] 4,025,179

[45] May 24, 1977

[54] PASSIVE CROSS MIXING SYSTEM

[75] Inventor: David H. Hudson, Holcomb, N.Y.

[73] Assignee: Xerox Corporation, Stamford, Conn.

[22] Filed: May 5, 1975

[21] Appl. No.: 574,491

[52] U.S. Cl. ..... 355/3 DD; 118/DIG. 24; 259/4 R; 259/180

[51] Int. Cl.[2] ..... G03G 15/08; B01F 5/00

[58] Field of Search ..... 355/3 DD; 259/180, 4 R, 259/4 AB; 118/637, DIG. 24

[56] References Cited

UNITED STATES PATENTS

| | | | |
|---|---|---|---|
| 3,395,898 | 6/1968 | Westelaken | 259/4 R |
| 3,697,050 | 10/1972 | Stanley | 259/4 R |
| 3,872,826 | 3/1975 | Hanson | 355/3 DD |

OTHER PUBLICATIONS

IBM Technical Disclosure; vol. 15, No. 3; Aug. 1972; "Cross Mixer For Developer"; Chaudhary & Moll; p. 756.

*Primary Examiner*—L. T. Hix

*Assistant Examiner*—J. A. LaBarre

*Attorney, Agent, or Firm*—J. J. Ralabate; H. Fleischer; C. A. Green

[57] ABSTRACT

An apparatus in which a developer material is moved adjacent an electrostatic latent image so that the latent image attracts the developer material thereto in image configuration. The developer material is advanced from a supply thereof to the latent image, with the unused developer material being returned thereto. As the developer material returns to the supply thereof, the velocity in the central region is greater than in the marginal regions.

The foregoing is achieved by passing the unused developer mix through a plate having a plurality of progressively shorter chutes in an inwardly direction disposed symmetrically about the central region thereof. In this manner, the unused developer mix has a greater velocity in the central region than in the marginal regions thereof preventing the developer mix from clogging the chutes of the plate.

8 Claims, 3 Drawing Figures

PASSIVE CROSS MIXING SYSTEM

BACKGROUND OF THE INVENTION

This invention relates generally to an electrostatographic printing machine, and more particularly concerns an improved development system for use therein.

In the process of electrostatographic printing, electrostatic charge patterns are formed and reproduced in viewable form. The field of electrostatography includes electrophotography and electrography. Electrophotography employs a photosensitive medium to form, with the aid of electromagnetic radiation, the electrostatic latent charge pattern. Electrography utilizes an insulating medium to form, without the aid of electromagnetic radiation, the electrostatic latent charge pattern. Development, which is the act of rendering an electrostatic latent pattern or image visible, is employed in all of the aforementioned types of electrostatography. Hereinafter, an electrophotographic process will be described as the illustrative embodiment having the features of the present invention incorporated therein.

An electrophotographic printing machine employs a photosensitive element having a photoconductive insulating layer which is charged to a substantially uniform potential so as to sensitize the surface thereof. The charged photoconductive surface is exposed to a light image of an original document being reproduced. As a consequence of the exposure, the charge is selectively dissipated in the irradiated areas in accordance with the light intensity reaching the surface thereof. This records an electrostatic latent image on the photoconductive surface. Development of the electrostatic latent image recorded on the photoconductive surface is achieved by bringing a developer mix adjacent thereto. A typical developer mix employs dyed or colored plastic particles, known in the art as toner particles, which are mixed with coarser carrier granules, such as ferromagnetic granules. In general, the toner particles are heat settable. The toner particles and carrier granules are selected so that the toner particles have the appropriate charge relative to the electrostatic latent image recorded on the photoconductive surface. When the developer mix is adjacent the photoconductive surface, the greater attractive force of the electrostatic latent image recorded thereon causes some of the toner particles to transfer from the carrier granules and adhere thereto. This concept was originally disclosed by Carlson in U.S. Pat. No. 2,297,691 and is further amplified and described by many related patents in the art.

In electrophotographic printing, excess developer mix is positioned adjacent the electrostatic latent image. The unused developer mix and denuded carrier granules are returned to the sump thereof for subsequent reuse. Mixing of the unused developer mix and denuded carrier granules with new toner particles is promoted by cross mixing the foregoing with one another. This insures that the triboelectric characteristics will be satisfactory. However, hereinbefore it has been found that the developer mix and unused carrier granules frequently clog or block the baffle preventing cross mixing. This may produce an erroneous indication of there being insufficient developer mix within the printing machine.

Accordingly, it is the primary object of the present invention to improve the development system by having cross mixing of the unused developer mix and denuded carrier granules without developer mix clogging.

BRIEF SUMMARY OF THE INVENTION

Briefly stated, and in accordance with the present invention, there is provided an apparatus for rendering an electrostatic latent image visible.

Pursuant to the features of the present invention, the apparatus includes means for moving a developer material adjacent to the latent image so that the latent image attracts a portion of the developer material thereto in image configuration. Means are provided for storing a supply of developer material. Returning means move the unused developer material from the latent image to the supply thereof at a greater velocity in the central region than in the marginal regions thereof.

BRIEF DESCRIPTION OF THE DRAWINGS

Other objects and advantages of the present invention will become apparent upon reading the following detailed description and upon reference to the drawings, in which.

Figure 1:
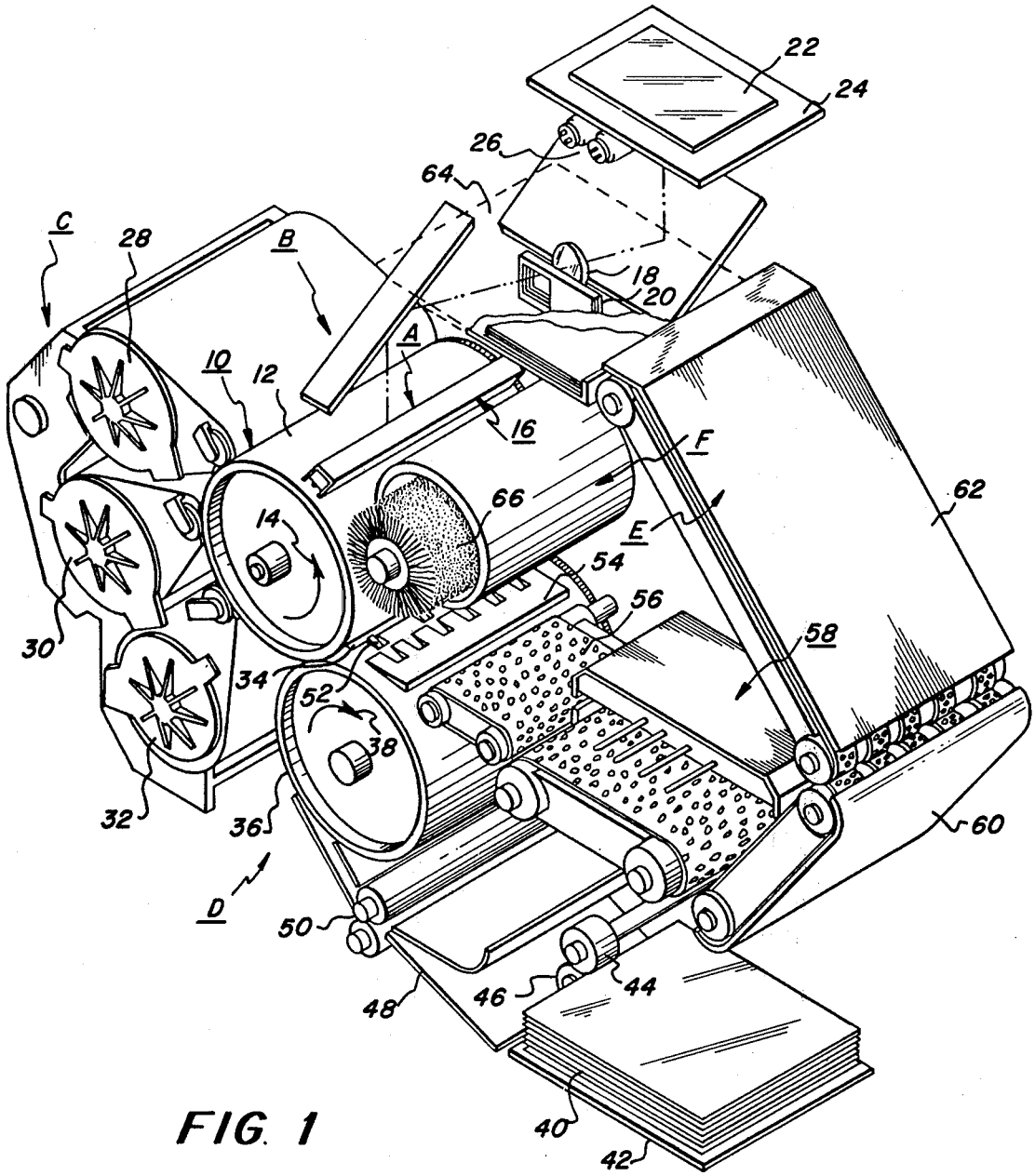
FIG. 1 is a schematic perspective view of an electrophotographic printing machine embodying the features of the present invention therein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of the illustrated electrophotographic printing machine, in which the present invention may be incorporated, reference is had to the drawings. In the drawings like reference numerals have been used throughout to designate like elements. Although the apparatus of the present invention is particularly well adapted for use in the development system of an electrophotographic printing machine, it will become apparent from the following description that it may be utilized in other machines.

A color electrophotographic printing machine is schematically illustrated in FIG. 1. The printing machine employs a photoconductive member, such as a rotatably mounted drum 10, having a photoconductive surface 12 secured thereto and entrained thereabout. Preferably, photoconductive surface 12 is formed from a panchromatic selenium alloy of the type described in U.S. Pat. No. 3,655,377 issued to Sechak in 1972. Drum 10 rotates in the direction of arrow 14 to move photoconductive surface 12 through a series of processing stations.

The machine cycle is initiated by charging photoconductive surface 12 to a relatively high and substantially uniform potential at charging station A. Charging station A includes a corona generating device, indicated generally by the reference numeral 16. Corona generating device 16 extends transversely across photoconductive surface 12 and sprays ions thereon to produce the requisite charge level.

Thereafter, drum 10 rotates the charged portion of photoconductive surface 12 to exposure station B. Exposure station B includes a moving lens system, generally designated by the reference numeral 18, and a color filter mechanism, shown generally at 20. An original document 22 is supported stationarily upon a transparent viewing platen 24. Moving lamp assembly 26 illuminates successive incremental areas of original document 22. Lamp assembly 26, lens 18, and filter 20 move in a timed relationship with photoconductive surface 12 to project a flowing light image of the original document thereon. During exposure, filter mechanism 20 interposes selected color filters into the optical light path. Thus, a single color light image is transmitted through each of the color filters to selectively discharge the charge on photoconductive surface 12 recording single color electrostatic latent images thereon. Each single color electrostatic latent image corresponds to a preselected spectral region of the electromagnetic wave spectrum. A suitable lens system is described in U.S. Pat. No. 3,597,531 issued to McCrobie in 1971. U.S. Pat. No. 3,775,006 issued to Hartman et al. in 1973 discloses a suitable filter mechanism.

After the electrostatic latent image is recorded on photoconductive surface 12, drum 10 rotates to development station C. Development station C includes three individual developer units, generally indicated by the reference numerals 28, 30, and 32, respectively. Each of these developer units is a magnetic brush system. In a magnetic brush development system, a magnetizable developer mix of carrier granules and toner particles is continually brought through a directional flux field to form a chain-like array frequently referred to as a brush of developer mix. The developer mix is continually moving to provide fresh developer mix to the brush thereof. Preferably, the developer unit comprises a magnetic member with a mass of developer mix adhering thereto by magnetic attraction. The developer mix includes carrier granules having toner particles clinging thereto by triboelectric attraction. Development is achieved by bringing the brush of developer mix into contact with the electrostatic latent image recorded on photoconductive surface 12. Each of the developer units 28, 30, 32, respectively, contain differently colored toner particles. For example, an electrostatic latent image formed by passing the light image through a green filter will record the red and blue portions of the spectrum as areas of relatively high charge density, while the green light rays will pass through the filter and cause the charge density on photoconductive surface 12 to be reduced to a voltage level ineffective for development. The charged areas are then made visible by applying green absorbing, magenta, toner particles to the latent image recorded on photoconductive surface 12. Similarly, a blue separation is developed with blue absorbing yellow toner particles, while the red separation is developed with the red absorbing cyan toner particles. The structure of the development system will be described hereinafter in greater detail with reference to FIGS. 2 and 3.

After development, the powder image on photoconductive surface 12 is moved to transfer station D. At transfer station D, the powder image is transferred to a sheet of support material 34, such as plain paper, amongst others. Support material 34, is secured releasably to transfer roll 36 which rotates in the direction of arrow 38. Transfer roll 36 is electrically biased to a suitable potential having a magnitude and polarity sufficient to electrostatically attract toner particles from photoconductive surface 12 to support material 34. Transfer roll 36 rotates in synchronism with drum 10, i.e., at the same tangential velocity, to permit successive single color toner powder images to be transferred to support material 34 in superimposed registration with one another. After the requisite number of toner powder images have been transferred to support material 34 (in this case three) support material 34 is separated from transfer roll 36.

Prior to proceeding with the remaining processing stations, the sheet feeding path will be briefly described. A stack 40 of support material 34 is disposed upon tray 42. Feed roll 44, operatively associated with retard roll 46, advances successive uppermost sheets from stack 40. The advancing sheet moves into chute 48 which guides it into the nip between register rolls 50. Register rolls 50 align and forward the advancing sheet to grippers 52 mounted on transfer roll 36. After the requisite number of toner powder images have been transferred to support material 34, gripper fingers 52 space support material 34 from transfer roll 36. As transfer roll 36 continues to rotate in the direction of arrow 38, stripper bar 54 is interposed between support material 34 and transfer roll 36. Support material 34 moves over stripper bar 54 onto endless belt conveyor 56. Endless belt conveyor 56 advances support material 34 to fixing station E.

At fixing station E, a suitable fusing device, indicated generally by the reference numeral 58, permanently affixes the toner powder image to support material 34. A suitable fusing device is described in U.S. Pat. No. 3,826,892 issued to Draugelis et al. in 1974. Thereafter, sheet 34 is advanced by endless belt conveyors 60 and 62 to catch tray 64 for subsequent removal therefrom by the machine operator.

Invariably, after the toner powder image is transferred to support material 34, toner particles remain adhering to photoconductive surface 12. Cleaning station F removes the residual toner particles from photoconductive surface 12. A pre-clean corona generating device (not shown) mounted thereat neutralizes the charge on the residual toner particles and photoconductive surface 12. Thereafter, a rotatably mounted fibrous brush 66, in contact with photoconductive surface 12, removes the toner particles therefrom.

Figure 2:
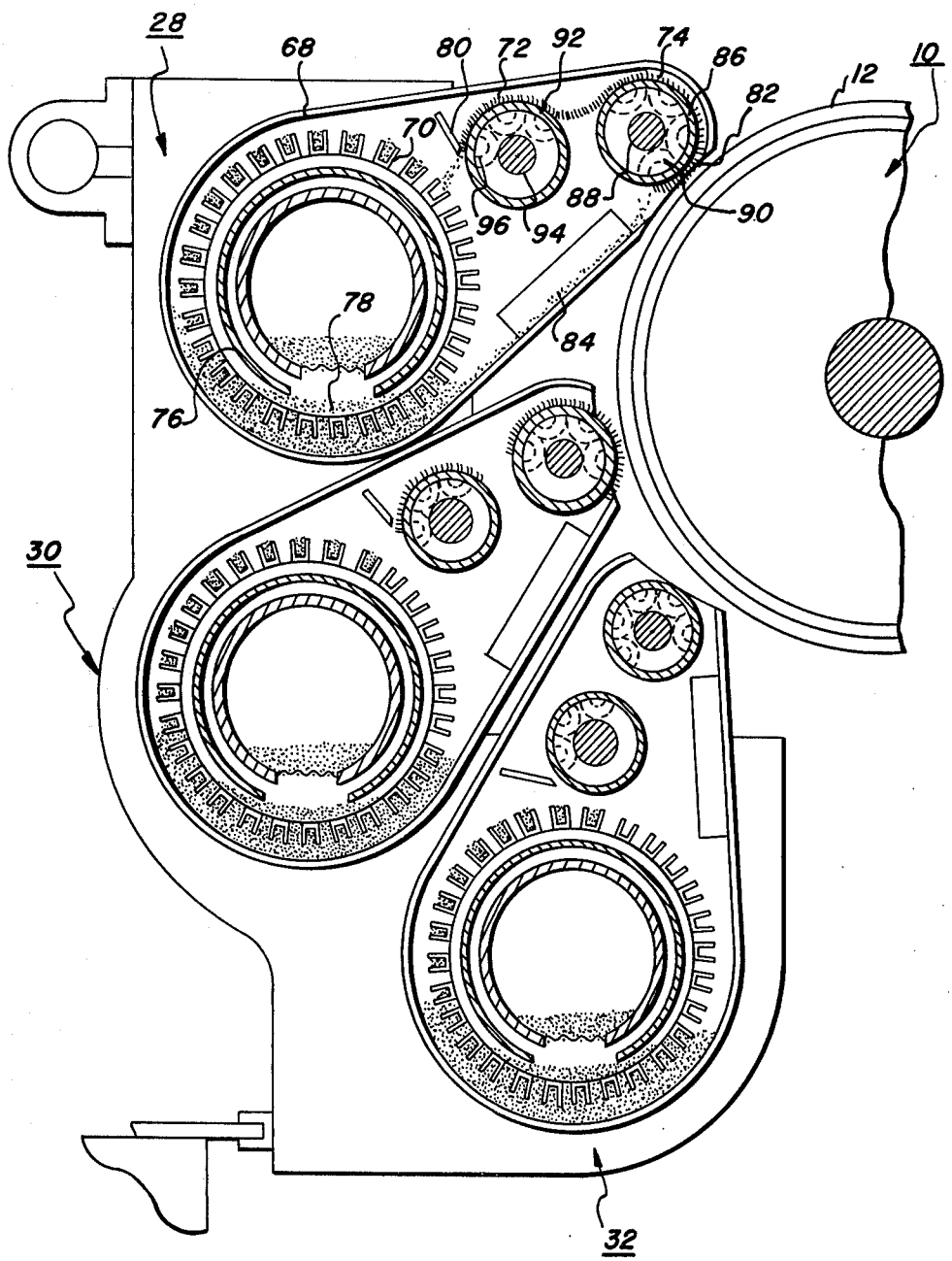
FIG. 2 is a sectional elevational view of the development system employed in the FIG. 1 printing machine.

Referring now to FIG. 2, there is shown the development system of the printing machine in greater detail. U.S. Pat. No. 3,854,449 issued to Davidson in 1974, describes this system in detail, the relevant portions thereof being hereby incorporated into the present application. Only development unit 28 will be described in detail, as development units 30 and 32 are nearly identical thereto. The distinctions between each developer unit reside in the color of the toner particles contained therein and minor geometrical differences due to the mounting position. Development unit 28 may have yellow toner particles, unit 30 magenta toner particles, and unit 32 cyan toner particles, although different color combinations may be employed. Referring now to development unit 28, this unit includes a housing 68, conveyor means or paddle wheel 70, transport means or roll 72, and developer means or roll 74. Paddle wheel 70 is a cylindrical member with buckets or scoops positioned about the periphery thereof. As paddle wheel 70 rotates the developer mix is elevated from the lower region of housing 68 to the upper region thereof. When the developer mix reaches the upper region of housing 68, it is lifted from the buckets in paddle wheel 70 to transport roll 72. Alternate buckets of paddle wheel 70 have apertures in the root diameter so that developer mix in these areas is not carried to transport roll 72, but, instead, falls back to the lower region of developer housing 68. As the developer mix falls to the lower region of developer housing 68, it cascades over shroud 76. Shroud 76 is of a tubular configuration with an aperture 78 in the lower region thereof. In this manner, the developer mix is continually recirculated so that the carrier granules are agitated to mix with fresh toner particles. This generates a strong triboelectric charge between the carrier granules and toner particles. As the developer mix, in the paddle wheel buckets, approaches transport roll 72, the magnetic field produced by the magnets therein attract the developer mix thereto. Transport roll 72 moves the developer mix in an upwardly direction by the frictional force exerted between the roll surface and developer mix. A surplus of developer mix is furnished. Metering blade 80 controls the amount carried over the top of transport roll 72. The surplus developer mix is sheared from transport roll 72 and falls in a downwardly direction toward paddle wheel 70. As the surplus developer mix descends, it falls through the apertures of paddle wheel 70 into the lower region of housing 68.

The developer mix which passes metering blade 80 is carried over transport roll 72 to developer roll 74 and into development zone 82 located between photoconductive surface 12 and developer roll 74. The electrostatic latent image recorded on photoconductive surface 12 is developed by contacting the moving developer mix. The charged areas on photoconductive surface 12 electrostatically attract toner particles from the carrier granules. At the exit of development zone 82, the strong magnetic fields in a generally tangentail direction to developer roll 74 continue to secure thereto the unused developer mix and the denuded carrier granules. Upon passing from the development zone, the unused developer mix and denuded carrier granules enter a region relatively free from magnetic forces and fall from developer roll 74 in a downwardly direction into the lower region of housing 68. As the unused developer mix and denuded carrier granules descend they pass through mixing baffle 84 which controls the rate of flow and diverts the flow from the marginal regions toward the central region thereof. This provides cross-mixing in the development unit. Mixing baffle 84 will be described hereinafter with reference to FIG. 3.

With continued reference to FIG. 2, developer roll 74 includes a non-magnetic tubular member 86, preferably made from aluminum having an irregular or roughened exterior surface. Tubular member 86 is journaled for rotation by suitable means such as ball bearing mounts. A shaft 88, made preferably of steel, is concentrically mounted within tubular member 86 and serves as a fixed mounting for magnetic means 90. Preferably, magnetic means 90 comprises magnets made of barium ferrite in the form of annular rings arranged with five poles on about a 284° arc about shaft 88.

Similarly, transport roll 72 includes a non-magnetic tubular member 92, preferably made from aluminum having an irregular or roughened exterior surface. Tubular member 92 is journaled for rotation by suitable means such as ball bearing mounts. A shaft 94, preferably made of steel, is concentrically mounted within tubular member 92 and functions as a fixed mounting for magnetic means 96. Magnetic means 96, preferably, includes barium ferrite magnets in the form of annular rings arranged with four poles on a 180° arc about shaft 94.

Figure 3:
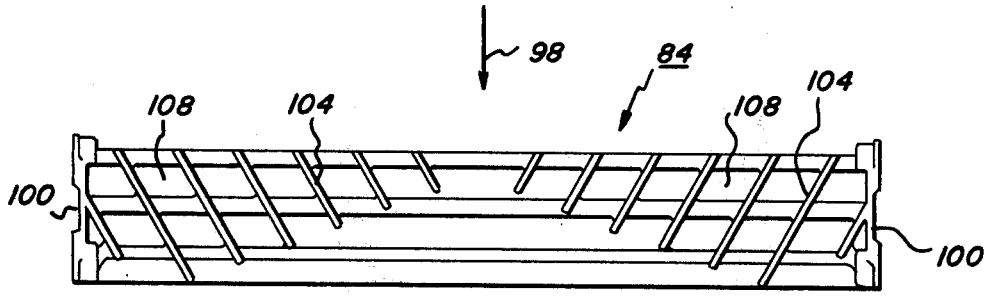
FIG. 3 is a plan view of the mixing baffle used in the FIG. 3 development system.

Referring now to FIG. 3, mixing baffle 84 is shown thereat in greater detail. Mixing baffle 84 directs the flow of developer mix toward the center of the development unit. This promotes cross-mixing of the developer mix. Mixing baffle or plate 84 directs the flow of unused developer mix and denuded carrier granules which descend in the direction of arrow 98 from the marginal regions 100 toward the central region 102 thereof. Plate 84 includes a plurality of vanes 104 extending in an upwardly direction normal to bottom surface 106. Vanes 104 are spaced from one another and extend in a direction transverse to the direction of flow, as indicated by arrow 98. In this manner, vanes 104 define a plurality of chutes 108 through which the developer mix passes. Inasmuch as these chutes 108 extend in a transverse direction to the direction of flow, the developer mix moves in a inwardly direction from marginal regions 100 to central region 102 produces cross-mixing. As shown in FIG. 3, vanes 104 are progressively shorter in an inwardly direction from marginal regions 100 to central region 102. Thus, chutes 108 are also progressively shorter in an inwardly direction from marginal region 100 to central region 102. Both vanes 104 and chutes 108 are symmetrical about central region 102. This arrangement increases the velocity of the developer mix in central region 102 while still maintaining a flow to central region 102 from the marginal regions 100. Higher velocity at the central region is achieved by progressively moving less developer mix to the central region while at the same time material nears the center of plate 84. This is achieved by designing vanes 104 so that vanes 104 in the central region are shorter than in the marginal regions. This allows more material to pass through the central region than in the marginal regions. In this way, the developer mix flow is regulated to prevent clogging or blockage of the mixing baffle with excessive material.

By way of example, plate 84 is made from sheet metal having twelve vanes 104 extending in an upwardly direction from bottom surface 106. Vanes 104 are of a progressively shorter length from one marginal region to the center thereof. The vanes then increase in length progressively from the center to the other marginal region. Thus, the vanes are arranged symmetrically about the center of plate 84.

In recapitulation, it is evident that the mixing baffle of the present invention regulates the rate of developer mix flow to provide a greater velocity in the central region than in the marginal regions. This insures that the developer mix does not clog and block the mixing baffle resulting in insufficient developer material being in the development unit producing poor copy quality.

It is, therefore, evident that there has been provided in accordance with the present invention, an apparatus for rendering an electrostatic latent image visible that fully satisfies the objects, aims, and advantages set forth above. While this invention has been described in conjunction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. An apparatus for rendering an electrostatic latent image visible with a developer material including:

a housing defining a chamber storing a supply of developer material therein;

means, located in the chamber of said housing, for moving the developer material from the chamber in said housing to the latent image so that the latent image attracts thereto a portion of the developer material in image configuration; and a plate member, disposed in the chamber of said housing, to receive the unattracted developer material, said plate member comprising a plurality of progressively shorter chutes in an inward direction disposed symmetrically about the central region thereof to direct the flow of developer material inwardly from the marginal regions to the central region with the developer material velocity being greater at the central region than in the marginal regions thereof, thereby preventing the developer material from clogging the chutes of said plate member.

2. An apparatus as recited in claim 1, wherein said moving means includes:

means for advancing the developer material from a first region to a second region for discharge thereat; and rotary driven developer means mounted within the chamber of said housing closely proximate to said advancing means for receiving the developer material therefrom, said developer means moving the developer material into contact with the latent image.

3. An apparatus as recited in claim 2, wherein said advancing means includes:

conveyor means mounted for movement within the chamber of said housing and arranged to move the developer material from a first region to an intermediate region; and rotary driven transport means mounted within the chamber of said housing and arranged to move the developer material from the intermediate region to the second region for discharge thereat.

4. An apparatus as recited in claim 3, wherein:

said transport means includes a first tubular member of non-magnetic material, and first magnetic means being mounted within said first tubular member for creating a magnetic field about the periphery of said first tubular member; and said developer means includes a second tubular member of non-magnetic material, and second magnetic means being mounted within said second tubular member for creating a magnetic field about the periphery of said second tubular member.

5. An electrophotographic printing machine of the type having a photoconductive member, means for charging the photoconductive member, and means for exposing the charged photoconductive member to a light image of an original document recording an electrostatic latent image thereon, wherein the improvement includes:

a housing defining a chamber storing a supply of developer mix comprising carrier granules and toner particles therein;

means, located in the chamber of said housing, for moving the developer mix from the chamber in said housing to the latent image so that the latent image attracts thereto a portion of the toner particles in image configuration; and a plate member, disposed in the chamber of said housing, to receive the unused developer mix and denuded carrier granules, said plate member comprising a plurality of progressively shorter chutes in an inward direction disposed symmetrically about the central region thereof to direct the flow of developer mix and denuded carrier granules inwardly from the marginal regions to the central region with the developer mix and denuded carrier granule velocity being greater at the central region than at the marginal regions thereof, thereby preventing the developer mix and denuded carrier granules from clogging the chutes of said plate member.

6. A printing machine as recited in claim 5, wherein said moving means includes:

means for advancing the developer mix from a first region to a second region for discharge thereat; and rotary driven developer means mounted within the chamber of said housing closely proximate to said advancing means for receiving the developer mix therefrom, said developer means moving the developer mix into contact with the latent image to deposit toner particles thereon.

7. A printing machine as recited in claim 6, wherein said advancing means includes:

conveyor means mounted for movement within the chamber of said housing and arranged to move the developer mix from a first region to an intermediate region; and rotary driven transport means mounted within the chamber of said housing and arranged to move the developer mix from the intermediate region to the second region for discharge thereat.

8. A printing machine as recited in claim 7, wherein:

said transport means includes a first tubular member of non-magnetic material, and first magnetic means being mounted within said first tubular member for creating a magnetic field about the periphery of said first tubular member; and said developer means includes a second tubular member of non-magnetic material, and second magnetic means being mounted within said second tubular member for creating a magnetic field about the periphery of said second tubular member.

* * * * *